US010619349B2

(12) United States Patent
Moretto et al.

(10) Patent No.: US 10,619,349 B2
(45) Date of Patent: Apr. 14, 2020

(54) FASTENING DEVICE FOR FASTENING LIGHTING DEVICES TO A FALSE CEILING

(71) Applicant: OSRAM GmbH, Munich (DE)

(72) Inventors: Stefano Moretto, Crocetta del Montello (IT); Simon Bobbo, Padua (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 16/157,213

(22) Filed: Oct. 11, 2018

(65) Prior Publication Data

US 2019/0112808 A1 Apr. 18, 2019

(30) Foreign Application Priority Data

Oct. 12, 2017 (IT) ..... 102017000115039

(51) Int. Cl.
*E04B 9/00* (2006.01)
*F21V 21/04* (2006.01)
(Continued)

(52) U.S. Cl.
CPC ..... *E04B 9/006* (2013.01); *F21S 8/04* (2013.01); *F21V 21/048* (2013.01);
(Continued)

(58) Field of Classification Search
CPC ..... F21V 21/048; F21V 21/104; E04B 9/006; E04B 9/067; E04B 9/068; E04B 2009/062; F21S 8/043
See application file for complete search history.

(56) References Cited

U.S. PATENT DOCUMENTS 3,797,791 A * 3/1974 Psencik ..... E04B 9/006 248/228.7
7,735,794 B1 * 6/2010 Gretz ..... E04B 9/006 248/200.1

(Continued)

FOREIGN PATENT DOCUMENTS

CA 2321341 A1 * 3/2002 ..... E04B 9/006
DE 9201639 U1 4/1992
WO 2017021900 A1 2/2017

OTHER PUBLICATIONS

Italian Search Report based on application No. 102017000115039 (6 pages) dated Mar. 16, 2018 (for reference purpose only).

*Primary Examiner* — Mary Ellen Bowman
(74) *Attorney, Agent, or Firm* — Viering, Jentschura & Partner MBB

(57) ABSTRACT

A fastening device for fastening lighting devices to T-shaped profiles of a false ceiling comprises a base wall on which the lighting device may be fastened. The fastening device also comprises two longitudinal side walls rigidly connected along the longitudinal sides of the base wall and a plurality of fastening elements arranged along the longitudinal sides of the base wall, wherein the fastening elements can be folded in the direction of the base wall, to engage the fastening device with the T-shaped profile. The fastening device also comprises at least two spacer elements arranged between the base wall and a respective longitudinal side wall to provide a gap between the side walls and the base wall. This gap provides a passage for the electrical connections between the lighting device and a power supply source located above the false ceiling.

10 Claims, 6 Drawing Sheets

(51) Int. Cl.

| | |
|---|---|
| ***F21S 8/04*** | (2006.01) |
| ***F21V 21/104*** | (2006.01) |
| ***E04B 9/06*** | (2006.01) |

(52) U.S. Cl.
CPC ..... *F21V 21/104* (2013.01); *E04B 9/068* (2013.01); *E04B 2009/062* (2013.01)

(56) References Cited

U.S. PATENT DOCUMENTS

| | | | | |
|---|---|---|---|---|
| 9,062,838 | B1 * | 6/2015 | Merrill, Jr. ..... | F21S 8/026 |
| 2004/0213003 | A1 | 10/2004 | Lauderdale et al. | |
| 2014/0036503 | A1 * | 2/2014 | Olsen ..... | F21S 8/026<br>362/249.02 |
| 2019/0072249 | A1 * | 3/2019 | Bobbo ..... | F21S 8/043 |

* cited by examiner

FASTENING DEVICE FOR FASTENING LIGHTING DEVICES TO A FALSE CEILING

CROSS-REFERENCE TO RELATED APPLICATION

This application claims priority to Italian Patent Application Serial No.: 102017000115039, which was filed Oct. 12, 2017, and is incorporated herein by reference in its entirety and for all reasons.

TECHNICAL FIELD

The present description refers to lighting devices.

One or more embodiments may refer to the assembly of lighting devices to a false ceiling.

One or more embodiments may concern a fastening device for fastening lighting devices to a false ceiling.

BACKGROUND

A false ceiling is a building construction with a lightweight structure placed under the ceiling of a building, which results in a decrease in the useful height of the room concerned. The false ceiling may be made to meet aesthetic requirements and to form a covering with heat-insulating, sound-absorbing or fire-resistant material. The false ceiling may also be used to house one or more systems in the compartment created between the false ceiling and the ceiling. The most typical system housed in the false ceiling is a lighting system.

The most widespread false ceiling structure envisages the use of a grid-shaped metal structure comprising a plurality of inverted T-shaped profiles, which may be fastened to the ceiling of the building by means of suspension wires. A false ceiling generally comprises a plurality of (by way of non-limiting example, square-shaped) panels having edges that may rest on lower horizontal wings of the T-shaped profiles of the false ceiling structure.

One of the most widespread solutions for installing a lighting system in a false ceiling envisages the use of panel-shaped lighting fixtures that are inserted in place of the respective false ceiling panels and that exactly occupy the space of a false ceiling panel.

An alternative lighting system, which is of increasing interest in the market, may envisage the use of linear lighting devices that replace corresponding sections of T-shaped profiles. A solution of this type may allow better integration, from an aesthetic point of view, of the lighting system in the false ceiling structure, since the lighting devices do not replace the false ceiling panels. However, this solution may involve installation difficulties due to the fact that it may be necessary to remove sections of the false ceiling supporting structure for assembling the linear lighting devices.

In addition to assembly problems, another aspect to consider is the electrical connection of the lighting devices to the electrical network. When the lighting devices replace a part of the false ceiling structure (false ceiling panels or sections of the T-shaped profiles), the electrical connections may be made on the upper part of the false ceiling.

However, in cases where the lighting fixtures do not replace portions of the false ceiling structure, it may be necessary to provide holes in the false ceiling structure for passing the electrical power supply cables. This solution has the disadvantage of making the installation of the lighting devices complicated. As an alternative to the provision of holes, it may be necessary to install electrical connectors on the sides of the false ceiling structure for electrical connection of the lighting devices. This solution has the disadvantage of having a negative effect on the aesthetic appearance of the false ceiling.

SUMMARY

One or more embodiments intend to contribute to overcoming the drawbacks outlined above.

More specifically, one or more embodiments aim to provide a fastening device for fastening lighting devices to a false ceiling structure, which may simplify both the mechanical fastening of the lighting devices to the false ceiling supporting structure and the electrical connection of the lighting device to the power supply.

According to one or more embodiments, these objects may be achieved by a device having the characteristics referred to in the following description.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various aspects are described with reference to the following drawings, in which.

It will be appreciated that, for clarity and simplicity of illustration, the various figures may not be reproduced on the same scale.

DETAILED DESCRIPTION

In the following description various specific details are illustrated that are aimed at a thorough understanding of examples of one or more embodiments. The embodiments may be implemented without one or more of the specific details, or with other methods, components, materials, etc. In other cases, known structures, materials, or operations are not shown or described in detail to avoid obscuring various aspects of the embodiments. The reference to "an embodiment" in the context of this description indicates that a particular configuration, structure or characteristic described in relation to the embodiment is included in at least one embodiment. Therefore, phrases such as "in an embodiment", possibly present in different places of this description do not necessarily refer to the same embodiment. Moreover, particular conformations, structures or characteristics may be combined in a suitable manner in one or more embodiments and/or associated with the embodiments in a different way from that illustrated here, by way of non-limiting example, a characteristic here exemplified in relation to a figure may be applied to one or more embodiments exemplified in a different figure.

The references illustrated here are only for convenience and do not therefore delimit the field of protection or the scope of the embodiments.

Figure 1:
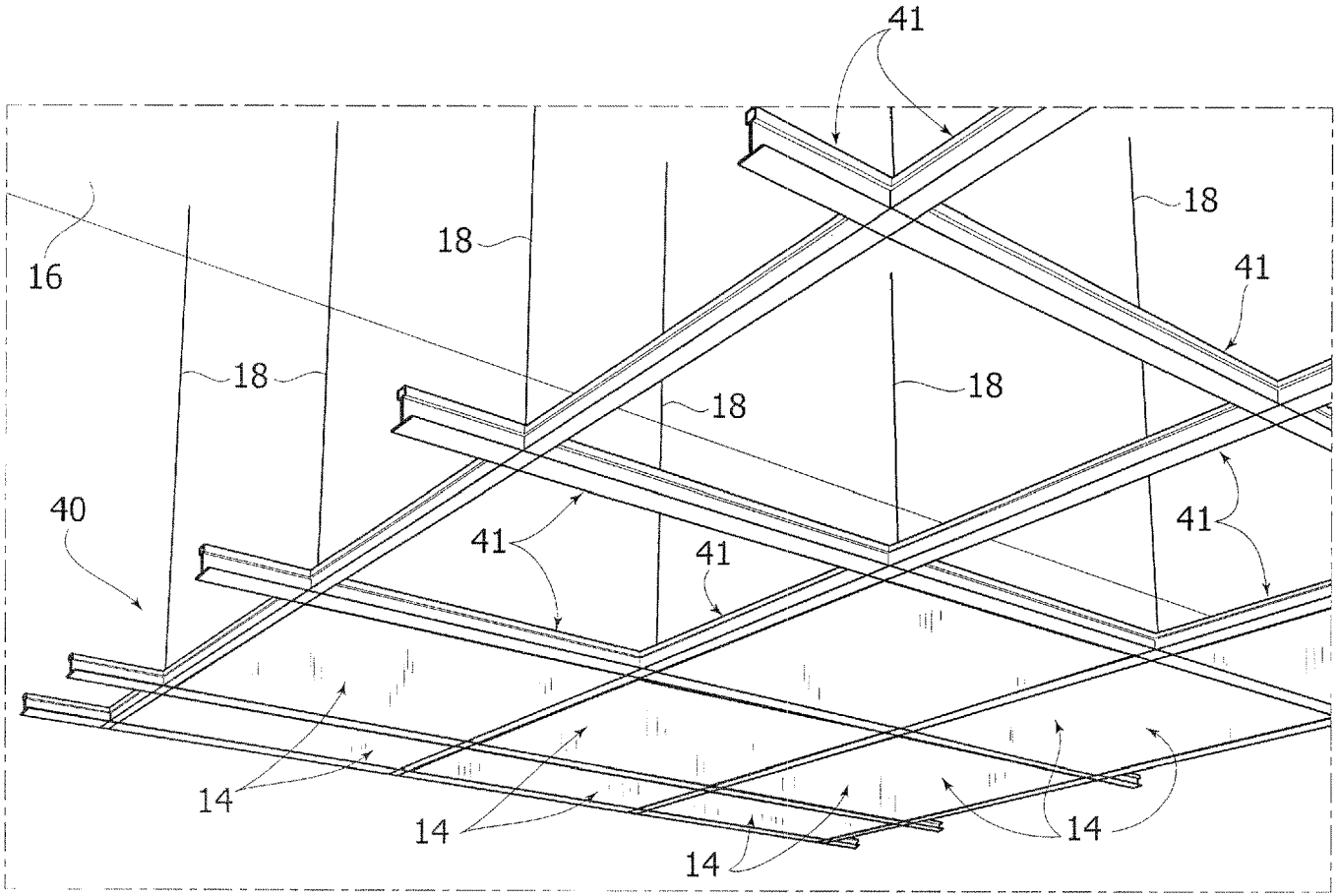
FIG. 1 is a perspective view illustrating a part of a false ceiling.

In FIG. 1, the reference 40 indicates a false ceiling of a building. The false ceiling 40 may comprise a grid-shaped supporting structure including a plurality of T-shaped profiles 41 and a plurality of false-ceiling panels 14, by way of non-limiting example, square-shaped, whose edges rest on the lower horizontal wings 9 of the T-shaped profiles 41. The T-shaped profiles 41 profiles may be fastened to a ceiling 16 of the building, by way of non-limiting example, by means of suspension wires 18.

Figure 2:
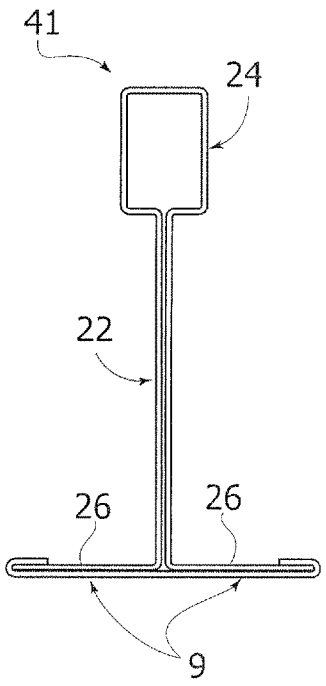
FIG. 2 is an enlarged cross-section illustrating a T-shaped profile of the false ceiling structure.

With reference to FIG. 2, the T-shaped profiles 41 may have an inverted T-shaped cross-section. The T-shaped profiles 41 may have horizontal wings 9 protruding from opposite sides of a vertical central rib 22. The T-shaped profiles 41 may be provided with upper heads 24. The lower horizontal wings 9 of the T-shaped profiles 41 may have upper surfaces 26 on which edges of false-ceiling panels 14 may rest.

In the present description the geometric references such as, by way of non-limiting example, horizontal, vertical, lower, upper, etc. refer to the position of normal use in a false ceiling and do not intend to limit the scope of application of the embodiments.

With reference to FIGS. 3-9, the reference 1 indicates a fastening device for fastening lighting devices 10, by way of non-limiting example, linear, to a false ceiling structure. The fastening device 1 may comprise a base wall 2 on which the lighting device 10 may be fastened (illustrated in FIGS. 8 and 9). The base wall 2 has a quadrangular shape with two longitudinal opposite sides 20 and two transversal opposite sides 21. The lighting device 10 may include at least one source of electrical power supply light radiation. The lighting device 10 may use one or more solid-state light radiation sources, by way of non-limiting example, LEDs, as the light radiation source.

Figure 9:
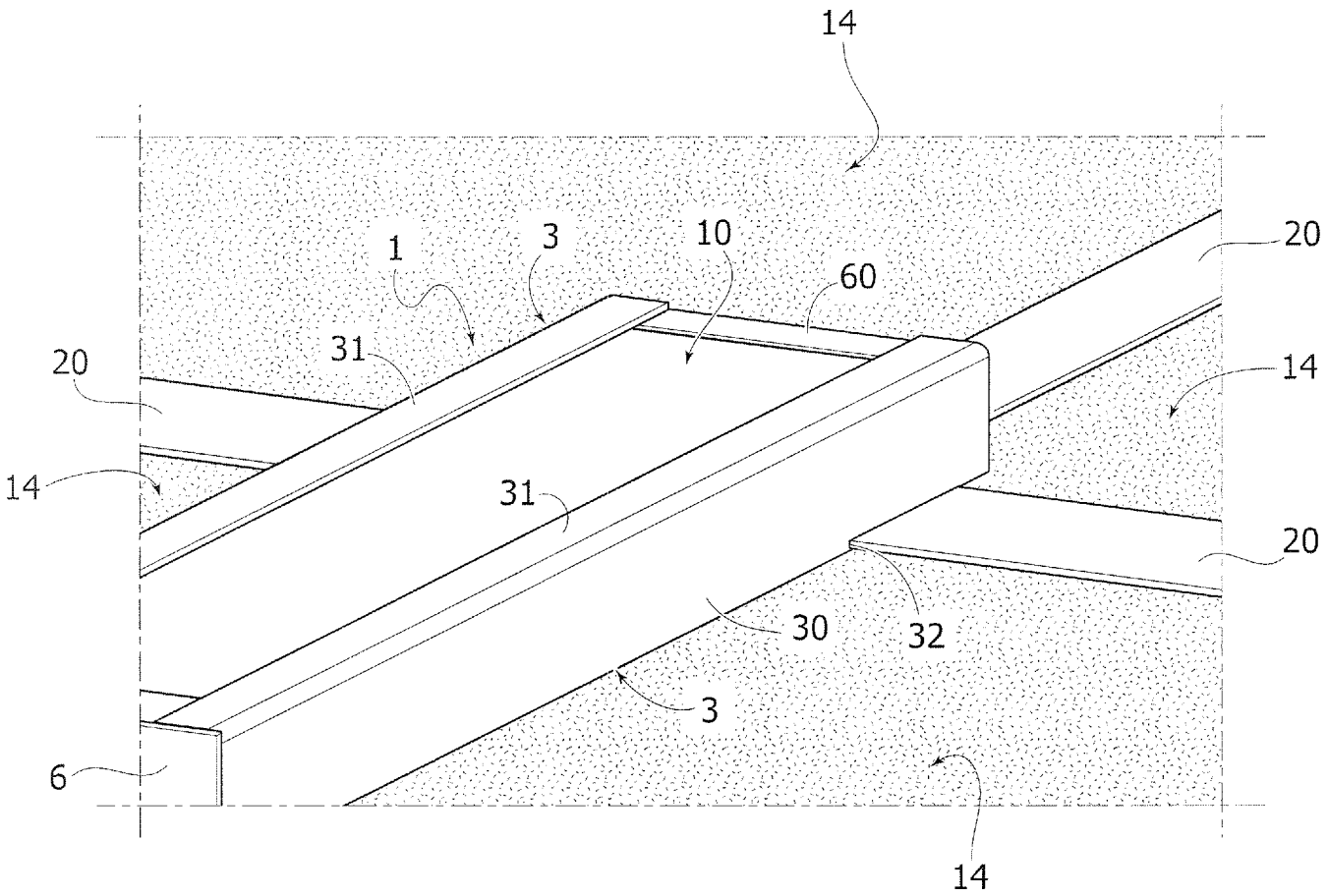
FIG. 9 is a perspective view on an enlarged scale showing a portion of a lighting device fastened to a false ceiling by means of a fastening device.

During use, the linear lighting device 10 may be in contact with the lower surface of the base wall 2 of the device 1 (FIG. 9). The lighting device 10 may be fastened to the base wall 2, by way of non-limiting example, by means of a tape.

The device 1 may also comprise two longitudinal side walls 3 rigidly connected along the longitudinal sides 20 of the base wall 2. The base wall 2 and the longitudinal side walls 3 may be made of different materials (by way of non-limiting example, metal or plastic).

Figure 5:
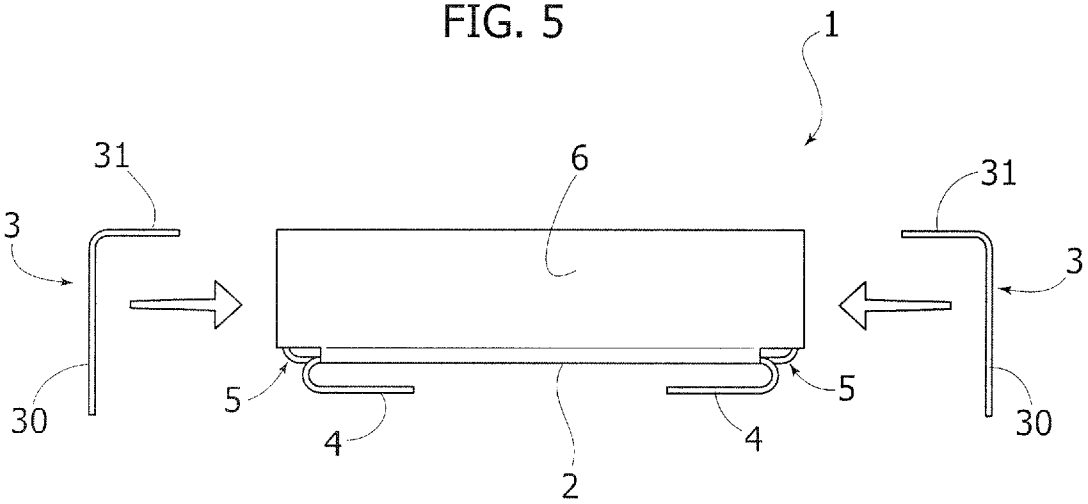
FIG. 5 is a front view illustrating the embodiment of the fastening device of FIGS. 3-4.
Figure 6:
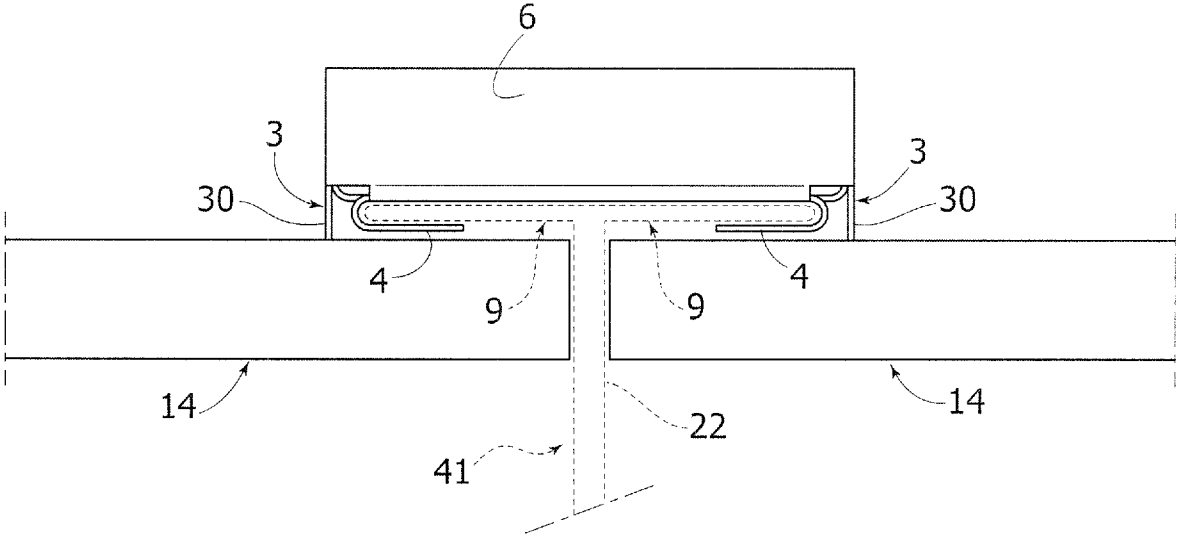
FIG. 6 is a front view of the fastening device of the preceding figures fastened to a T-shaped profile of a false ceiling structure.

In one or more non-limiting embodiments, the device 1 may comprise a plurality of fastening elements 4 located along the longitudinal sides 20 of the base wall 2 (FIGS. 5 and 6). During use of the device 1, the fastening elements 4 may be folded in the direction of the upper surface of the base wall 2, to engage the fastening device 1 with a T-shaped profile 41 of the false ceiling. Still with reference to the use of the device 1, the fastening elements 4 rest on an upper surface 26 of a horizontal wing 9 of the T-shaped profile 4 of the false ceiling 40.

In a non-limiting embodiment of the device 1, the fastening elements 4 are quadrangular plate elements, which may be different in number and shape for each longitudinal side 20 of the base wall 2. Purely by way of non-limiting example, at one of the two longitudinal sides 20 of the base wall 2, three fastening elements 4 may be provided with small dimensions (10-20 mm in length), while at the opposite side a single fastening element with a significantly larger extension than the others (150 mm in length) may be provided.

Figure 3:
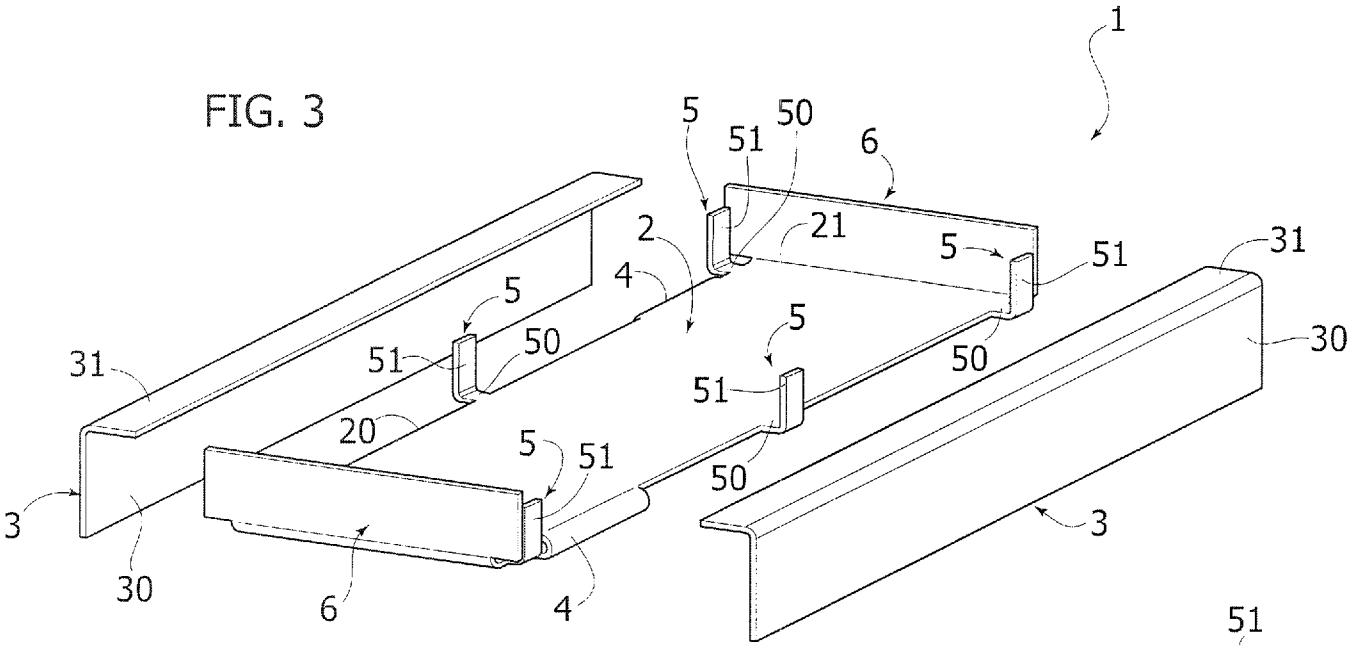
FIG. 3 is an exploded perspective view illustrating an embodiment of a fastening device for fastening a lighting device to a false ceiling structure.

In one or more non-limiting embodiments, the device may also comprise at least two spacer elements 5. Each of these spacer elements 5 is arranged along a portion of a respective longitudinal side 20 of the base wall 2 and, in particular, each spacer element 5 is interposed between the base wall 2 and the respective longitudinal side wall 3 (FIG. 3).

Figure 8:
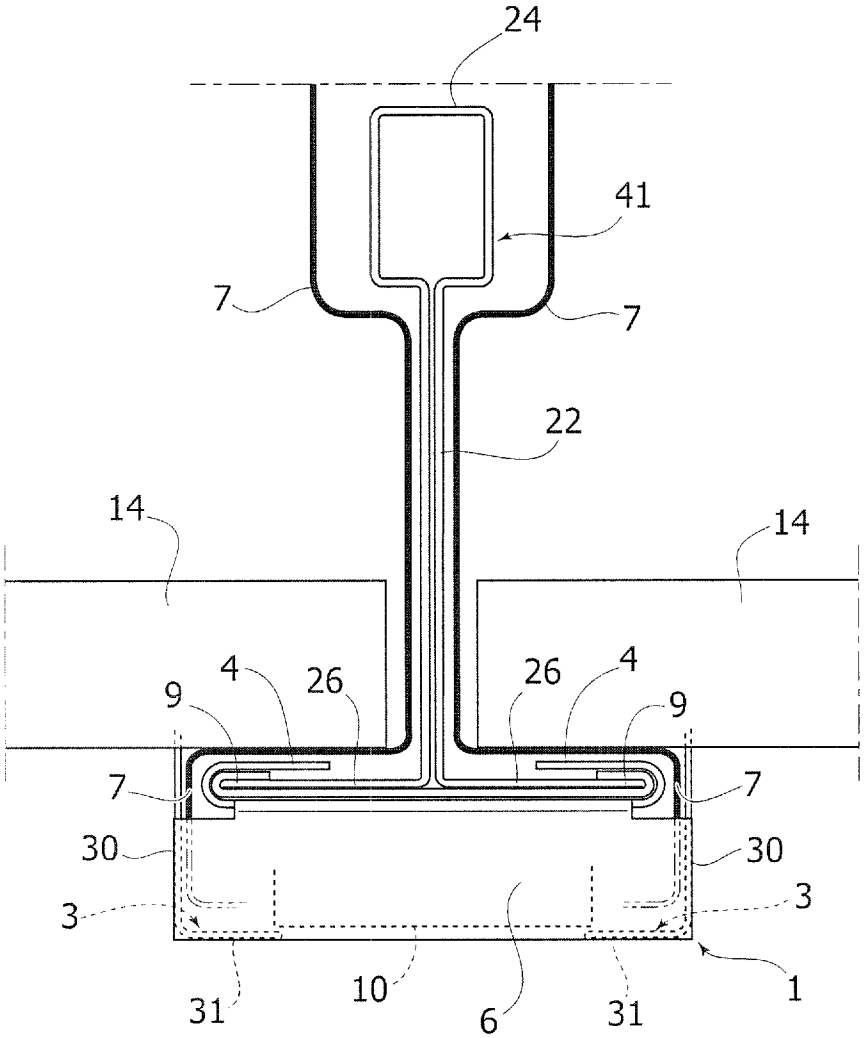
FIG. 8 is a cross-sectional view of a lighting device fastened to a T-shaped profile of a false ceiling structure, by means of the fastening device of the preceding figures.

This arrangement of the spacer elements 5 is configured to provide a gap between the side wall 3 and the base wall 2, in order to provide a passage for the electrical connections 7 between the lighting device 10 and a power supply source located above the false ceiling 40 (seen in cross-section in FIG. 8). In the non-limiting embodiment illustrated in the drawings, the device 1 comprises three spacer elements on each side of the base wall 2 (FIG. 3).

In one or more non-limiting embodiments, the longitudinal side walls 3 of the device 1 have an L-shaped conformation. This L-shaped conformation of the side walls 3 provides a vertical portion 30 extending in a direction perpendicular to the base wall 2 adjacent to the aforesaid spacer elements 5 and a horizontal portion 31 perpendicular to the portion 30, which is configured to cover the gap formed between the side wall 3 and the base wall 2 of the device 1 (FIGS. 1, 2 and 8). The horizontal portions 31 may provide, during use, in particular at the part facing the ceiling, a support for any additional optical elements (by way of non-limiting example, covering optical elements "covers"), as well as a support plane for the lighting device 10.

In one or more non-limiting embodiments, the spacer elements 5 also have an L-shaped conformation, in which a horizontal portion 50 lies on the same plane as the base wall 2 of the device 1 and a vertical portion 51 is adjacent to a vertical portion 30 of a respective side wall 3 (FIGS. 1, 2 and 8). The side walls 3 may be glued, welded or mechanically fastened to the vertical portions 51 of the spacer elements 5.

Figure 4:
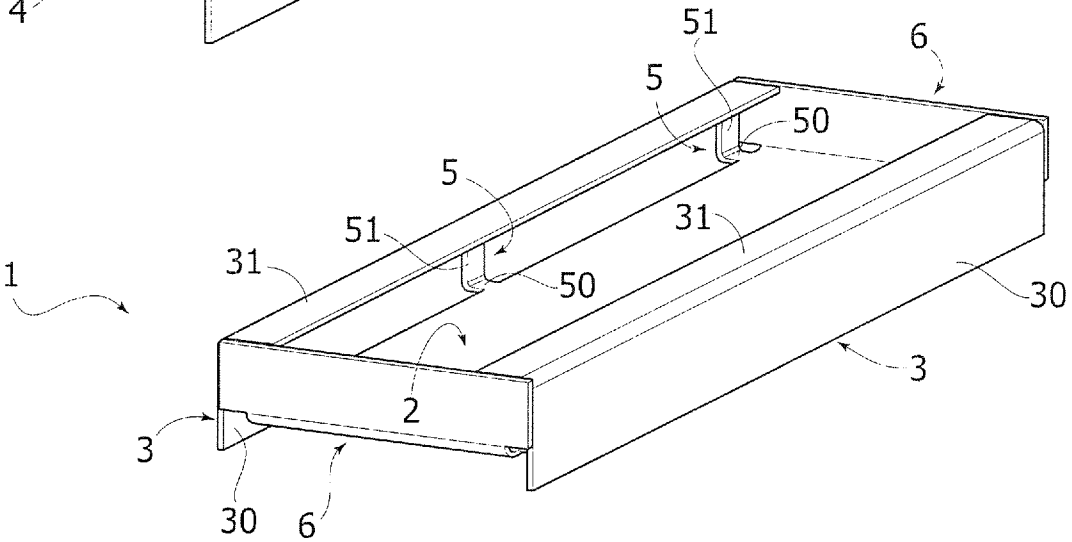
FIG. 4 is an additional perspective view illustrating the embodiment of the fastening device of the previous figure.

In one or more non-limiting embodiments, the fastening device 1 also comprises two transversal side walls 6 arranged along the transversal sides 21 of the base wall 2 (FIGS. 3 and 4).

The transversal side walls 6 may have a portion 60 foldable in the direction of the lighting device 10 fastened to the base wall 2 of the false ceiling 1 (FIG. 9). Of course, this last characteristic may also be absent without affecting the functionality of the device 1.

Figure 7B:
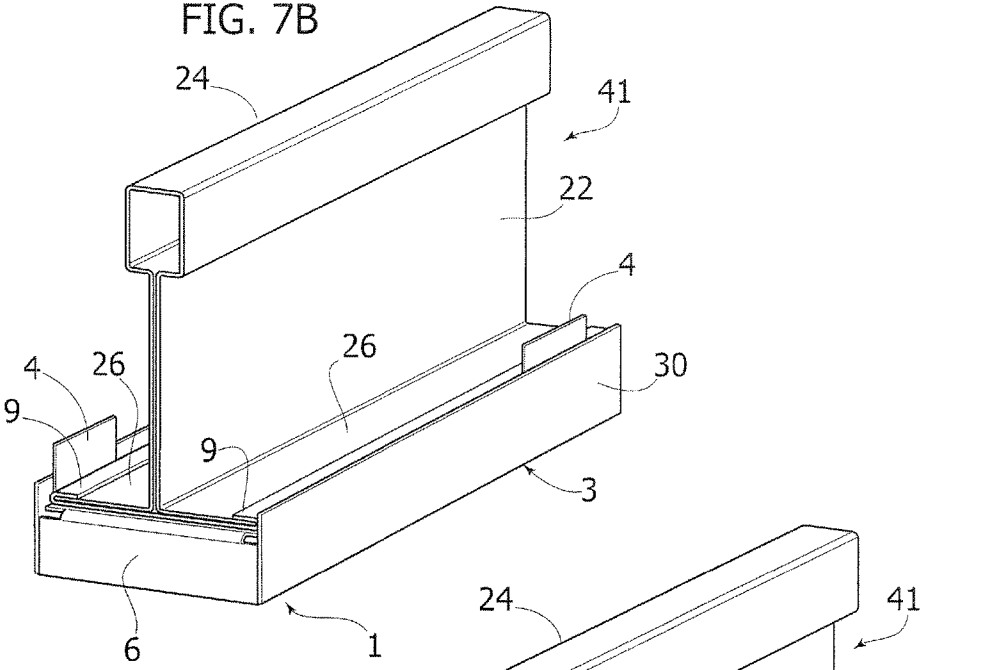
FIGS. 7A-7C are perspective views illustrating the steps of assembling the device of the preceding figures to a T-shaped profile of a false ceiling structure.
Figure 7C:
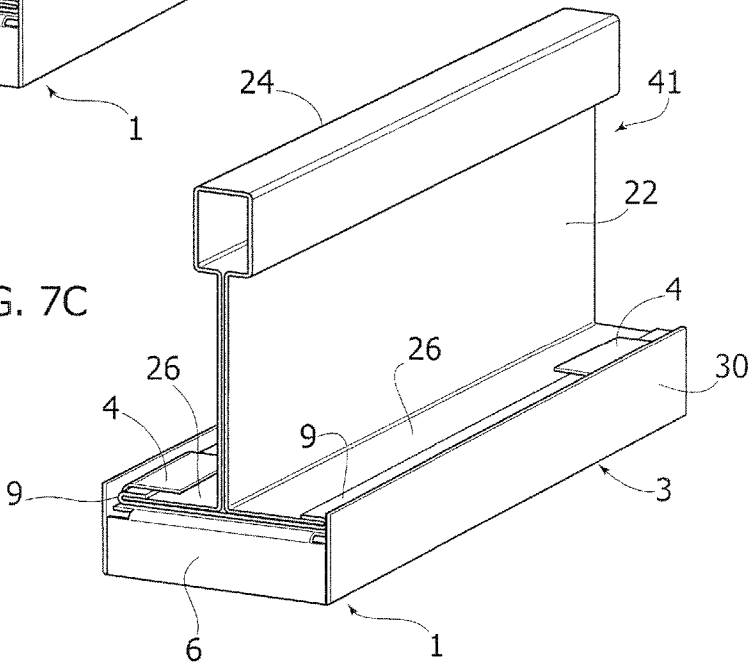
Figure 7A:
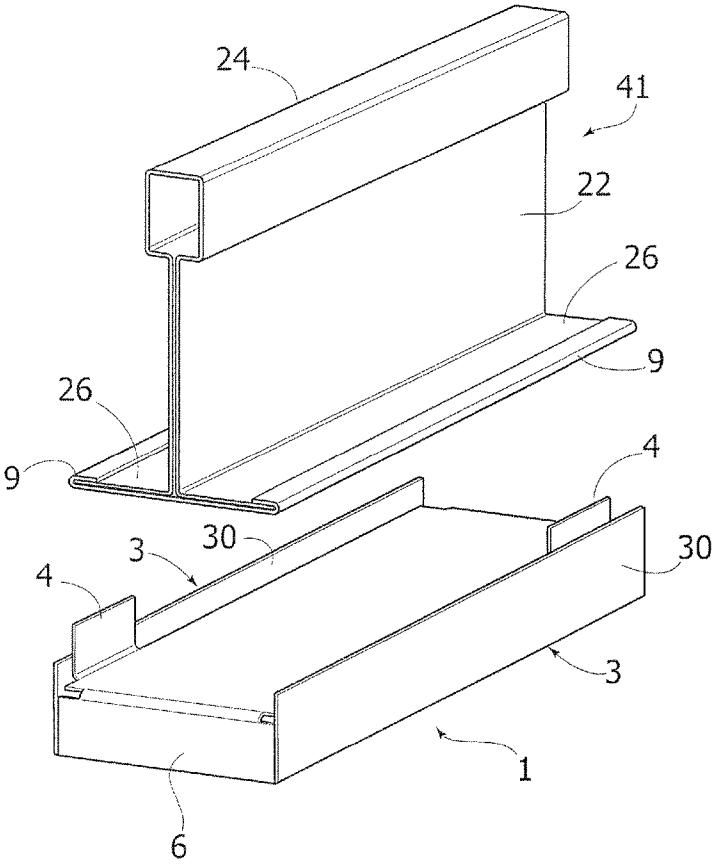

With reference to FIGS. 7A-7C, the fastening steps of a non-limiting embodiment of the device 1 to a T-shaped profile 41 are illustrated. Firstly, the base wall 2 is aligned with the horizontal wings 9 of the T-shaped profile 41. Subsequently, the fastening elements 4 are folded in the direction of the base wall 2 to engage the device 1 with the T-shaped profile.

As illustrated in FIG. 8, the device 1, during use, protrudes below the false ceiling 40 beyond a distal edge of the wing 9 of the T-shaped profile 41. The base wall 2 and the side walls 3,6 enclose the lighting device 10 fastened to the base wall 2. The electrical connections 7 of the lighting device may pass through the empty spaces between the side walls 3 and the base wall 2. The horizontal portions 31 of the side walls 3 cover the previously described empty spaces thus making the aesthetic appearance of the false ceiling uniform.

With reference in particular to FIG. 9, in one or more non-limiting embodiments, the side walls 3 may have a grooved portion 32 at their vertical portion 30 to allow, during use, installation of the device 1 at the intersection of two or more horizontal wings 9 of respective T-shaped profiles 41.

One or more non-limiting embodiments may have one or more of the following advantages:

- the mechanical fastening of the lighting devices to the supporting structure of the false ceiling and the electrical connection of the lighting devices may be carried out without replacing or modifying parts of the false ceiling structure, so that the installation is simpler and faster,
- given the gap formed between the base wall and the longitudinal side walls, to allow the passage of the electrical connections of the lighting device, and given the horizontal portion of the L-shaped side walls configured to cover this gap, the electrical connection of the lighting devices may result in having no adverse effects on the appearance of the false ceiling and on the simplicity of installation of the device,
- the side walls of the fastening devices may be produced or painted with a color similar to the color of the false ceiling, so that the fastening devices may be perfectly integrated with the aesthetic appearance of the false ceiling.

One or more non-limiting embodiments may, therefore, concern a fastening device (e.g. 1) for fastening lighting devices (e.g. 10) to T-shaped profiles (e.g. 41) of a false ceiling (e.g. 40) comprising:

- a base wall (e.g. 2) on which the lighting device (e.g. 10) is fastenable, wherein the base wall (e.g. 2) has two longitudinal opposite sides (e.g. 20) and two transversal opposite sides (e.g. 21),
- two longitudinal side walls (e.g. 3) rigidly connected along the longitudinal sides (e.g. 20) of the base wall (e.g. 2),
- a plurality of fastening elements (e.g. 4) provided along the longitudinal sides (e.g. 20) of the base wall (e.g. 2), wherein the fastening elements (e.g. 4) are foldable in the direction of the base wall (e.g. 2), for engaging the fastening device (e.g. 1) with the T-shaped profile (e.g. 41),
- at least two spacer elements (e.g. 5) each located along a portion of a respective longitudinal side (e.g. 20) of the base wall (e.g. 2), each spacer element (e.g. 5) being arranged between the base wall (e.g. 2) and the respective side wall (e.g. 3), in order to provide a gap between the side wall (e.g. 3) and the base wall (e.g. 2), wherein the gap provides a passage for the electrical connections (e.g. 7) between the lighting device (e.g. 10) and a power supply source located above the false ceiling (e.g. 40).

In one or more non-limiting embodiments of the fastening device, the longitudinal side walls (e.g. 3) have an L-shaped conformation comprising:

- a vertical portion (e.g. 30) extending in a direction perpendicular to the base wall (e.g. 2), the vertical portion (e.g. 30) being adjacent to the spacer elements (e.g. 5), and
- a horizontal portion (e.g. 31), extending in a direction parallel to the base wall (e.g. 2), wherein the horizontal portion (e.g. 31) covers the gap between the side wall (e.g. 3) and the base wall (e.g. 2) of the device (e.g. 1).

In one or more non-limiting embodiments of the fastening device, the spacer elements (e.g. 5) have an L-shaped conformation, in which a horizontal portion (e.g. 50) lies on the same plane as the base wall (e.g. 2) and a vertical portion (51) is adjacent to a respective side wall (e.g. 3).

In one or more non-limiting embodiments of the fastening device, the device may comprise two transversal side walls (e.g. 6) rigidly connected along the transversal sides (e.g. 21) of the base wall (e.g. 2).

In one or more non-limiting embodiments of the fastening device, the fastening elements (e.g. 4), during use, are supported by an upper surface (e.g. 8) of a horizontal wing (e.g. 9) of the T-shaped profile (e.g. 41) of the ceiling (e.g. 40).

In one or more non-limiting embodiments of the fastening device, the base wall (e.g. 2) and the longitudinal side walls (e.g. 3) enclose the lighting device (e.g. 10) which, during use, protrudes below the false ceiling (e.g. 40) beyond a distal edge of the wing (e.g. 9) of a T-shaped profile (e.g. 41) of the false ceiling (e.g. 40).

In one or more non-limiting embodiments of the fastening device, the side walls (e.g. 3) have a grooved portion (e.g. 32) to allow, during use, installation of the device at the intersection of two or more horizontal wings (e.g. 9) of the T-shaped profile (e.g. 41).

In one or more non-limiting embodiments of the fastening device, the horizontal portions (e.g. 31) of the longitudinal side walls (e.g. 3) provide, during use, in particular at the part facing the ceiling, a support for any additional optical elements, as well as a support surface for the lighting device (e.g. 10).

One or more non-limiting embodiments may concern a system for fastening lighting devices (e.g. 10) to T-shaped profiles (e.g. 41) of a false ceiling (e.g. 40), comprising at least one fastening device (e.g. 1) according to one or more of the previous claims.

Without prejudice to the underlying principles of the invention, the details of construction and the embodiments may vary, even significantly, with respect to those illustrated here, purely by way of non-limiting example, without departing from the scope of the invention.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

LIST OF REFERENCE SIGNS

| | |
|---|---|
| False ceiling | 40 |
| T-shaped profile | 41 |
| False ceiling panel | 14 |
| Ceiling | 16 |
| Suspension wires | 18 |
| Horizontal wings | 9 |
| Vertical central rib | 22 |
| Upper head | 24 |
| Upper surfaces | 26 |
| Lighting device | 10 |
| Fastening device | 1 |
| Base wall | 2 |
| Longitudinal sides | 20 |
| Transversal sides | 21 |

-continued

| LIST OF REFERENCE SIGNS | |
|---|---|
| Longitudinal side walls | 3 |
| Vertical portion | 30 |
| Horizontal portion | 31 |
| Grooved portion | 32 |
| Fastening elements | 4 |
| Spacer elements | 5 |
| Horizontal portion | 50 |
| Vertical portion | 51 |
| Electrical connections | 7 |
| Transversal side walls | 6 |
| Folding portion | 60 |

What is claimed is:

1. A fastening device for fastening one or more lighting devices to T-shaped profiles of a false ceiling, comprising:

a base wall on which the one or more lighting devices are fastenable, wherein the base wall has two longitudinal opposite sides and two transversal opposite sides, two longitudinal side walls rigidly connected along the longitudinal sides of the base wall, a plurality of fastening elements provided along the longitudinal sides of the base wall, wherein the fastening elements are foldable in a direction of the base wall, for engaging the fastening device with the T-shaped profile, at least two spacer elements each located along a portion of a respective longitudinal side of the base wall, each spacer element arranged between the base wall and a respective side wall to provide a gap between the respective side wall and the base wall, wherein the gap provides a passage for one or more electrical connections between the one or more lighting devices and a power supply source located above the false ceiling.

2. A fastening device according to claim 1, wherein the longitudinal side walls have an L-shaped conformation comprising:

a vertical portion extending in a direction perpendicular to the base wall, wherein the vertical portion is adjacent to the spacer elements, and a horizontal portion, extending in a direction parallel to the base wall, wherein the horizontal portion covers the gap between the respective side wall and the base wall of the device.

3. A fastening device according to claim 1, wherein the spacer elements have an L-shaped conformation, wherein a horizontal portion lies on the same plane of the base wall and a vertical portion is adjacent to a respective side wall of the device.

4. A fastening device according to claim 1, wherein the fastening elements are supported on an upper surface of a horizontal wing of the T-shaped profile of the false ceiling.

5. A fastening device according to claim 1, wherein the base wall and the longitudinal side walls enclose the one or more lighting devices and protrude beneath the false ceiling beyond a distal edge of the wing of the T-shaped profile of the false ceiling.

6. A fastening device according to claim 1, wherein the fastening device has two transversal side walls rigidly connected along the transversal sides of the base wall.

7. A fastening device according to claim 1, wherein the side walls have a grooved portion for enabling installation of the device at an intersection of two or more horizontal wings of respective T-shaped profiles.

8. A fastening device according to claim 2, wherein the horizontal portions provide a support for any additional optical elements, and a support plane for the one or more lighting devices.

9. A system for fastening one or more lighting devices to T-shaped profiles of a false ceiling, the system comprising at least one fastening device, the at least one fastening device comprising:

a base wall on which the one or more lighting devices are fastenable, wherein the base wall has two longitudinal opposite sides and two transversal opposite sides, two longitudinal side walls rigidly connected along the longitudinal sides of the base wall, a plurality of fastening elements provided along the longitudinal sides of the base wall, wherein the fastening elements are foldable in a direction of the base wall, for engaging the fastening device with the T-shaped profile, at least two spacer elements each located along a portion of a respective longitudinal side of the base wall, each spacer element arranged between the base wall and a respective side wall to provide a gap between the respective side wall and the base wall, wherein the gap provides a passage for one or more electrical connections between the one or more lighting devices and a power supply source located above the false ceiling.

10. A fastening device according to claim 8, wherein the support is provided at a part facing the ceiling.

* * * * *